United States Patent [19]

LaSpisa et al.

[11] Patent Number: 4,497,283

[45] Date of Patent: Feb. 5, 1985

[54] BOILER CONTROL

[75] Inventors: Ronald J. LaSpisa; Merle R. Likins, Jr., both of Bartlesville, Okla.

[73] Assignee: Phillips Petroleum Company, Bartlesville, Okla.

[21] Appl. No.: 553,443

[22] Filed: Nov. 18, 1983

[51] Int. Cl.[3] ..... F22D 5/26

[52] U.S. Cl. ..... 122/451.1; 122/414; 122/504; 236/14

[58] Field of Search ..... 122/448 R, 448 A, 448 B, 122/448 S, 451 R, 451 S, 451.1, 451.2, 414, 504; 236/14, 15 R

[56] References Cited

U.S. PATENT DOCUMENTS

| | | | |
|---|---|---|---|
| 3,042,007 | 7/1962 | Chien et al. | 122/448 |
| 3,284,615 | 11/1966 | Yetter | 236/14 |
| 3,417,737 | 12/1968 | Shinskey et al. | 122/448 |
| 3,545,207 | 12/1970 | Barber et al. | 122/448 R |
| 3,908,897 | 9/1975 | van Holtz et al. | 236/14 |
| 4,003,342 | 1/1977 | Hodgson | 236/14 |
| 4,023,537 | 5/1977 | Carter, Sr. et al. | 122/448 S |
| 4,064,699 | 12/1977 | Martz | 122/448 R |
| 4,242,989 | 1/1981 | Chamberlain | 122/451 R |
| 4,457,266 | 7/1984 | LaSpisa | 236/14 |

*Primary Examiner*—Edward G. Favors
*Assistant Examiner*—Steven E. Warner
*Attorney, Agent, or Firm*—French and Doescher

[57] ABSTRACT

The control of the actual liquid level in a boiler is accomplished by using the flow rate of the fuel to the combustion system associated with the boiler to generate a signal which is utilized to bias a control signal generated in response to steam flow rate and the output from a conventional level controller in such a manner that swell and shrink caused by changes in fuel flow rate is compensated for and the desired liquid level is maintained in the boiler.

10 Claims, 1 Drawing Figure

BOILER CONTROL

Figure 1:
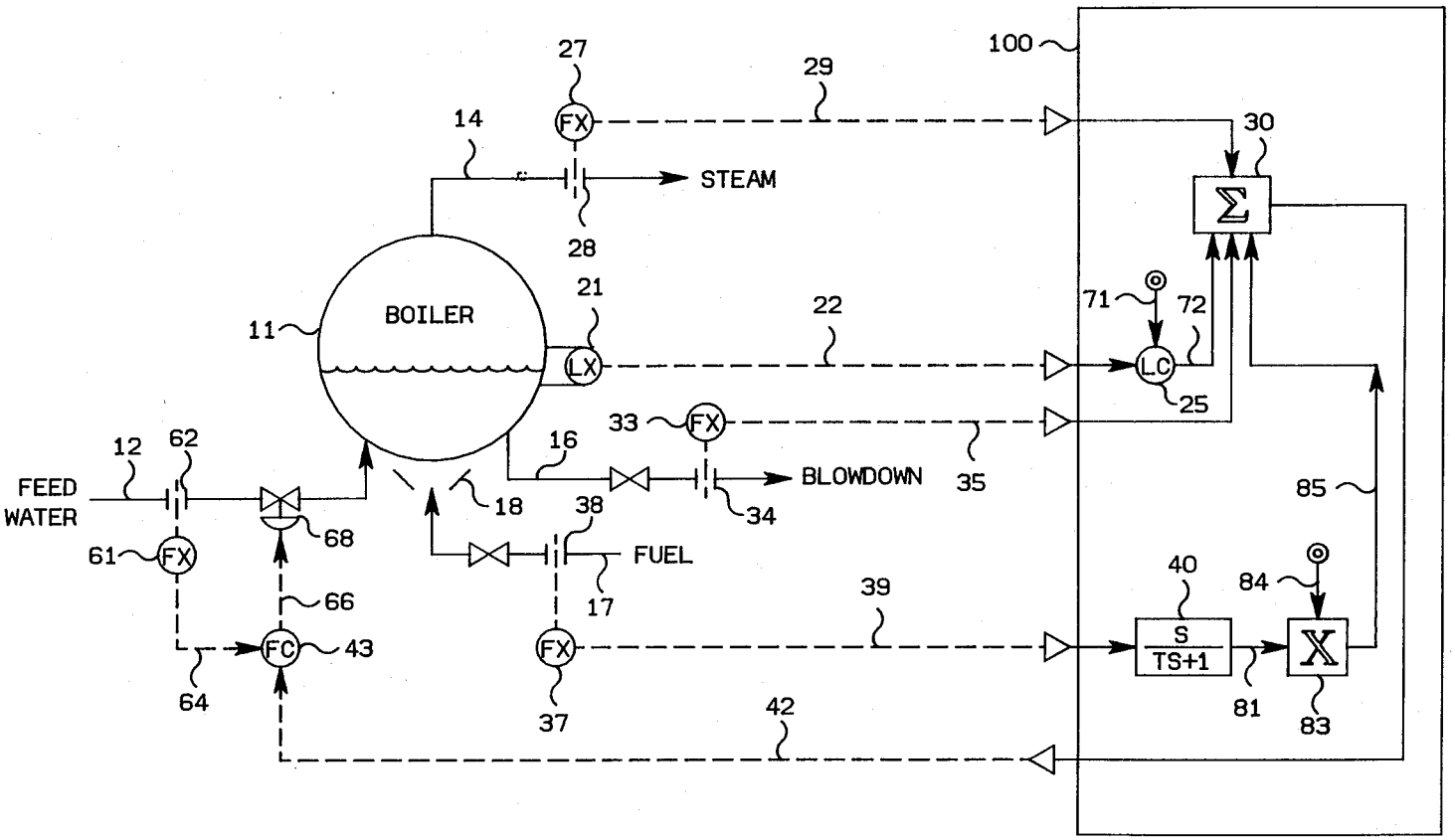

This invention relates to control of a boiler. In one aspect, this invention relates to method and apparatus for maintaining a desired liquid level in a boiler.

Boilers are utilized in many processes to supply steam. In general, it is desirable to maintain a particular liquid level in the boiler and conventional level control is often utilized to accomplish this. However, phenomena known as "shrink" and "swell" make it difficult to maintain a desired liquid level in a boiler using conventional level control where the control action is based on liquid level in the boiler.

The term "shrink" is a conventional term which refers to the affect of an increase in pressure on the liquid level in the boiler. When steam demand decreases, the result is an increase in pressure in the boiler and the water in the drum shrinks i.e., the water level is reduced.

The term "swell" is also a conventional term which refers to the affect on the water level of an increase in the load on the boiler i.e., an increase in steam demand. Pressure in the drum decreases when steam demand increases due to an increase in demand and the water in the drum swells i.e., the level of the water increases.

We have also found that shrink and swell may be caused by a change in fuel flow to a boiler. As an example, when an increase in boiler loading causes an increase in the fuel firing rate (increased fuel flow) bubbling is increased and the phenomena of swell occurs. In like manner, a decrease in fuel firing rate can result in a decrease in bubbling which causes the phenomena of shrink to occur.

The phenomenon of shrink and swell can cause exactly the opposite from the desired control action to be taken when conventional level control is being utilized to control the liquid level in a boiler. As an example, when the fuel flow increases due to an increase in demand it is also necessary to increase the flow of the feedwater to the boiler. However, the first thing that happens is that bubbling in the drum increases due to the increased flame temperature and the water in the drum swells. This causes the level controller to sense that the level is too high and the level controller will begin to cut back on the feedwater which is the exact opposite of the desired response.

It is thus an object of this invention to provide method and apparatus for controlling the liquid level in a boiler which compensates for the phenomena of shrink and swell caused by changes in the fuel firing rate (fuel flow rate).

In accordance with the present invention, method and apparatus is provided whereby the actual flow rate of fuel to the burners associated with the boiler is utilized to generate a signal which is utilized to bias the output from a conventional level controller in such a manner that swell and shrink caused by disturbances is compensated for. It has been found that control based on the actual flow rate of the fuel provides a very quick response (feed forward) and enables a desired liquid level to be maintained even when boiler demand is changing rapidly (which causes a change in fuel demand).

Other objects and advantages of the invention will be apparent from the foregoing brief description of the invention and the claims as well as the detailed description of the drawing which is briefly described as follows:

FIG. 1 is a diagrammatic illustration of a boiler and the associated control system of the present invention.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal tranmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an OPTROL 700 Process Control System from Applied Automation, Inc., Bartlesville, Oklahoma.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an oiutput signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1, there is illustrated a conventional boiler 11. Feedwater is supplied to the boiler 11 through conduit means 12. Steam is removed from the boiler 11 through conduit means 14. Water is removed from the boiler 11 through conduit means 16. The water removed through conduit 16 is typically referred to as the "blow-down water" and is utilized to remove impurities which tend to concentrate in the lower portion of the boiler 11.

Fuel is supplied to the burner system 18 associated with the boiler 11 through conduit means 17. Typically, a plurality of burners might be associated with a single boiler. The fuel utilized is generally a conventional fuel such as natural gas or a heating oil.

Other conventional equipment which would normally be associated with the boiler 11, such as pumps and additional control elements, are not illustrated since such additional equipment plays no part in the description of the present invention.

In general, control of the liquid level in the boiler 11 is accomplished by using process measurements to establish a control signal for the flow rate of the feedwater. The process measurements will first be described and then the use of the control signal will be described. Thereafter, the generation of the control signal will be described.

Level transducer 21, which is operably connected to the boiler 11 so as to be able to sense the liquid level in the boiler 11, provides an output signal 22 which is representative of the actual liquid level in the boiler 11. Signal 22 is provided from the level transducer 21 to computer 100 and is specifically provided to the level controller 25.

Flow transducer 27 in combination with the flow sensor 28, which is operably located in conduit means 14, provides an output signal 29 which is representative of the actual flow rate of steam through conduit means 14. Signal 29 is provided from the flow transducer 27 as an input to computer 100 and is specifically provided as a first input to the summing block 30.

In like manner, flow transducer 33 in combination with the flow sensor 34, which is operably located in conduit means 16, provides an output signal 35 representative of the flow rate of water through conduit means 16. Signal 35 is provided from the flow transducer 33 as an input to computer 100 and is specifically provided as a second input to the summing block 30.

Flow transducer 37 in combination with the flow sensor 38, which is operably located in conduit means 17, provides an output signal 39 which is representative of the actual flow rate of fuel through conduit means 17. Signal 39 is provided from the flow transducer 37 as an input to computer 100 and is specifically provided as an input to the differentiator block 40.

In response to the described input signals, computer 100 generates a control signal 42 which is representative of the flow rate of the feed water through conduit means 12 requied to maintain a desired liquid level in the boiler 11. Signal 42 is supplied from computer 100 as the set point input to the flow controller 43.

Flow transducer 61 in combination with the flow sensor 62, which is operably located in conduit means 12, provides an output signal 64 which is representative of the actual flow rate of the feedwater through conduit means 12. Signal 64 is provided from the flow transducer 61 as the process variable input to the flow controller 43.

In response to signals 42 and 64, the flow controller 43 provides an output signal 66 which is responsive to the difference between signals 42 and 64. Signal 66 is scaled so as to be representative of the position of the control valve 68, which is operably located in conduit means 12, required to maintain the actual flow rate of the feedwater through conduit means 12 substantially equal to the desired flow rate represented by signal 42. Signal 66 is provided from the flow controller 43 as the control signal for control valve 68 and control valve 68 is manipulated in response thereto.

The manner in which the control signal 42 is generated in response to the described process measurements is as follows:

The level controller 25 is also supplied with a set point signal 71 which is representative of the desired liquid level in the boiler 11. A typical value for signal 71 is a liquid level which would maintain a volume of liquid equal to about 15% of the total volume of the boiler 11. In response to signals 22 and 71, the level controller 21 provides an output signal 72 which is responsive to the difference between signals 22 and 71. Signal 72 is provided from the level controller 25 as a third input to the summing block 30.

At steady-state conditions the flow rate of steam plus the flow rate of the blow-down water flowing through conduit means 16 should equal the flow rate of the feed water. Ideally, such an equality would maintain the desired liquid level in the boiler 11. If desired, the desired liquid level in the boiler 11 can be maintained based only on the steam flow rate since this flow rate will be much greater than the flow rate of the blow-down water. However, control of the liquid level based on both the flow rate of the steam and the flow rate of the blow-down water is preferred for the sake of accuracy.

During periods of process upsets, control of the feed water flow rate based only on the flow rate of the steam flow rate and blow-down water flow rate may not be able to maintain a desired liquid level in the boiler. The level controller 25 is utilized in these situations to maintain a desired liquid level. In particular, signal 72 is scaled so as to be representative of a difference between the sum of the flow rate of the steam and blow-down water and the flow rate of the feedwater required to maintain a desired liquid level in the boiler. Thus, the sum of signals 29, 35 and 72 would typically be representative of the desired flow rate of the feedwater through conduit means 12 and this summation would be provided as the set point signal to the flow controller 43. However, control based on such a summation does not compensate for shrink or swell caused by changes in the flow rate of the fuel. This compensation is provided in accordance with the present invention based on the fuel flow rate.

The manner in which a compensating signal based on the fuel flow rate is derived is as follows:

As has been previously stated, signal 39 is provided to the differentiator block 40. The differentiator block 40 is conventional. In the equation illustrated in the derivative block 40, S is the Laplace operator and T is a time constant. The time T is chosen as the average time required for the affect of a shrink or swell to dissipate. A typical value for T is 200 seconds. The output signal from the differentiator block 40 will be representative of the derivative of signal 39. Signal 81, which is representative of such derivative, is supplied from the differentiator block 40 as an input to the multiplying block 83.

The multiplying block 83 is also supplied with a biasing signal 84. Signal 84 would typically be derived by a step test in which the fuel flow rate is subjected to a step change and the magnitude of the change in water level due to swell or shrink is observed. Signal 84 would be chosen so as to compensate for such a change in water level.

Signal 81 is multiplied by signal 84 to establish signal 85. Signal 85, which continues to have the units of flow rate, is considered a biasing signal which compensates for the effect of shrink and swell caused by changes in the fuel flow rate. Signal 85 is provided as a fourth input to the summing block 30.

It is noted that, it the fuel flow rate is not changing, signal 81 will be equal to zero and signal 85 will thus be equal to zero. Also, the magnitude of signal 81 will decrease after a change occurs and reach zero at the end of a time period equal to about 3 time constants (3T). Thus, the bias term represented by signal 85 will have a magnitude only during periods of changing fuel flow rate and then only for the period of time necessary to compensate for shrink or swell caused by changes in fuel flow rate.

Signals 29, 72, 35 and 85 are all summed to establish signal 42. As has been previously stated, signal 42 is representative of the flow rate of the feedwater through conduit means 12 required to maintain a desired liquid level in the boiler 11. Signal 42 is provided as a control signal from computer 100 and is utilized as has been previously described.

In summary, it has been found that shrink and swell may be caused by changes in fuel flow rate to a boiler. In accordance with the present invention, a bias signal is generated based on the fuel flow rate. This bias signal is utilized to compensate for shrink and swell caused by changes in the fuel flow rate and is present only when a change in the fuel flow rate occurs and then only for the period of time required for compensation.

The invention has been described in terms of a preferred embodiment as illustrated in FIG. 1. Specific components which can be used in the practice of the invention as illustrated in FIG. 1, such as level transducer 21, flow transducers 27, 33, 37 and 61, flow sensors 28, 34, 38 and 62, flow controller 43 and control valve 68 are each well known, commercially available control components such as are described at length in Perry's Chemical Engineers Handbook 4th Ed., chapter 22, McGraw-Hill. It is also noted that, while preferably the level controller 25 is implemented by means of a computer, the level controller 25 could also be implemented by means of a conventional analog controller if desired.

While the invention has been described in terms of the presently preferred embodiment, reasonable variations and modifications are possible by those skilled in the art and such modifications and variations are within the scope of the described invention and the appended claims.

That which is claimed is:

1. Apparatus comprising:

a boiler;

means for supplying feedwater to said boiler;

means for withdrawing steam from said boiler;

means for supplying fuel to a combustion system associated with said boiler, wherein the combustion of said fuel supplies heat to said boiler;

means for establishing a first signal representative of the actual flow rate of said steam;

means for establishing a second signal representative of the actual liquid level in said boiler;

means for establishing a third signal representative of the desired liquid level in said boiler;

means for comparing said second signal and said third signal and for establishing a fourth signal which is responsive to the difference between said second signal and said third signal, wherein said fourth signal is scaled so as to be representative of the difference between the flow rate of steam withdrawn from said boiler and the actual flow rate of said feedwater required to maintain a desired liquid level in said boiler;

means for establishing a fifth signal representative of the actual flow rate of said fuel;

means for establishing a biasing signal, which compensates for the swell or shrink caused by a change in the flow rate of said fuel, in response to said fifth signal;

means for summing said first signal, said fourth signal and said biasing signal to establish a control signal representative of the flow rate of said feedwater required to maintain a desired liquid level in said boiler; and means for manipulating the flow rate of said feedwater to said boiler in response to said control signal to thereby maintain a desired liquid level in said boiler.

2. Apparatus in accordance with claim 1 wherein said means for establishing said biasing signal in response to said fifth signal comprises:

a differentiating means;

means for providing said fifth signal to said differentiating means, wherein said differentiating means establishes a sixth signal representative of the differential of said fifth signal; and means for multiplying said sixth signal by a biasing term to establish said biasing signal, wherein said biasing term has a magnitude which compensates for changes in the liquid level in said boiler caused by changes in the fuel flow rate when said biasing term is multiplied by said sixth signal.

3. Apparatus in accordance with claim 1 additionally comprising:

means for withdrawing a blow-down water stream from said boiler; and means for establishing a sixth signal representative of the actual flow rate of said blow-down water stream, wherein said sixth signal is summed with said first signal, said fourth signal and said biasing signal to establish said control signal and wherein said fourth signal is scaled so as to be representative of the difference between the sum of said first signal and said sixth signal and the actual flow rate of said feedwater required to maintain a desired liquid level in said boiler.

4. Apparatus in accordance with claim 3 wherein said means for establishing said biasing signal in response to said fifth signal comprises:

a differentiating means;

means for providing said fifth signal to said differentiating means, wherein said differentiating means establishes a seventh signal representative of the differential of said fifth signal; and means for multiplying said seventh signal by a biasing term to establish said biasing signal, wherein said biasing term has a magnitude which compensates for changes in the liquid level in said boiler caused by changes in the fuel flow rate when said biasing term is multiplied by said seventh signal.

5. Apparatus in accordance with claim 4 wherein said means for controlling the flow of said feedwater in response to said control said comprises:

a control valve operably located so as to control the flow of said feedwater;

means for establishing an eighth signal representative of the actual flow rate of said feedwater;

means for comparing said control signal and said eighth signal and for establishing a ninth signal which is responsive to the difference between said control signal and said eighth signal, wherein said ninth signal is scaled so as to be representative of the position of said control valve required to maintain the actual flow rate of said feedwater substantially equal to the desired flow rate represented by said control signal; and means for manipulating said control valve in response to said ninth signal.

6. A method for controlling the actual liquid level in a boiler to which feedwater is supplied and from which steam is withdrawn, wherein a fuel is supplied to a combustion system associated with said boiler and wherein the combustion of said fuel supplies heat to said boiler, said method comprising the steps of:

establishing a first signal representative of the actual flow rate of said steam;

establishing a second signal representative of the actual liquid level in said boiler;

establishing a third signal representative of the desired liquid level in said boiler;

comparing said second signal and said third signal and establishing a fourth signal which is responsive to the difference between said second signal and said third signal, wherein said fourth signal is scaled so as to be representative of the difference between the flow rate of steam withdrawn from said boiler and the actual flow rate of said feedwater required to maintain a desired liquid level in said boiler;

establishing a fifth signal representative of the actual flow rate of said fuel;

establishing a biasing signal, which compensates for the swell or shrink caused by a change in the flow rate of said fuel, in response to said fifth signal;

summing said first signal, said fourth signal and said biasing signal to establish a control signal representative of the flow rate of said feedwater required to maintain a desired liquid level in said boiler; and manipulating the flow rate of said feedwater to said boiler in response to said control signal to thereby maintain a desired liquid level in said boiler.

7. A method in accordance with claim 6 wherein said steps of establishing said biasing signal in response to said fifth signal comprises:

differentiating said fifth signal to establish a sixth signal representative of the differential of said fifth signal; and multiplying said sixth signal by a biasing term to establish said biasing signal, wherein said biasing term has a magnitude which compensates for changes in the liquid level in said boiler caused by changes in the fuel flow rate when said biasing term is multiplied by said sixth signal.

8. A method in accordance with claim 6 wherein a blow-down water stream is withdrawn from boiler, said method additionally comprising the step of establishing a sixth signal representative of the actual flow rate of said blow-down water stream, wherein said sixth signal is summed with said first signal, said fourth signal and said biasing signal to establish said control signal and wherein said fourth signal is scaled so as to be representative of the difference between the sum of said first signal and said sixth signal and the actual flow rate of said feedwater required to maintain a desired liquid level in said boiler.

9. A method in accordance with claim 8 wherein said step of establishing said biasing signal in response to said fifth signal comprises:

differentiating said fifth signal to establish a seventh signal representative of the differential of said fifth signal; and multiplying said seventh signal by a biasing term to establish said biasing signal, wherein said biasing term was magnitude which compensates for changes in the liquid level in said boiler caused by changes in the fuel flow rate when said biasing term is multiplied by said seventh signal.

10. A method in accordance with claim 9 wherein said step of controlling the flow of said feedwater in response to said control signal comprises:

establishing an eighth signal representative of the actual flow rate of said feedwater;

comparing said control signal and eighth signal and establishing ninth signal which is responsive to the difference between said control signal and said eighth signal, wherein said ninth signal is scaled so as to be representative of the position of a control valve, operably located so as to control the flow of said feedwater, required to maintain the actual flow rate of said feedwater substantially equal to the desired flow rate represented by said control signal; and manipulating said control valve in response to said ninth signal.

* * * * *